United States Patent [19]

Hofberg et al.

[11] 4,355,720

[45] Oct. 26, 1982

[54] PACKAGE FOR DISPENSING PRECUT TAPE SEGMENTS

[76] Inventors: Robert Hofberg, 866 Morefield Rd., Philadelphia, Pa. 19115; Bonnie D. Goldstein, 6647 Kindred St., Philadelphia, Pa. 19149; Roy H. Wepner, 7 Quince Pl., North Brunswick, N.J. 08902

[21] Appl. No.: 181,882

[22] Filed: Aug. 27, 1980

[51] Int. Cl.[3] ..... B65D 73/00

[52] U.S. Cl. ..... 206/460; 206/447; 206/472

[58] Field of Search ..... 206/460, 441, 447, 472, 206/473, 813, 820

[56] References Cited

U.S. PATENT DOCUMENTS

| | | | |
|---|---|---|---|
| 1,543,283 | 6/1925 | Flaor et al. | 206/447 X |
| 2,815,126 | 12/1957 | Deckers | 206/820 X |
| 3,191,767 | 6/1965 | Glowiak | 206/460 |
| 3,334,736 | 8/1967 | Cole et al. | 206/460 |
| 3,347,361 | 10/1967 | Lindeke | 206/460 X |
| 3,797,147 | 3/1974 | Lemberg | 206/472 X |

*Primary Examiner*—Steven M. Pollard

*Attorney, Agent, or Firm*—Lerner, David, Littenberg & Samuel

[57] ABSTRACT

A package for storing and dispensing precut segments of tape with adhesive backing includes a plurality of pieces of sheet material having first and second ends and at least an upper surface with a smooth texture adapted to releasably retain tape with adhesive backing. The pieces of sheet material are releasably bound at the first ends of the pieces of sheet material and are constructed and arranged to allow removal of one of the sheets from the package. A plurality of elongated segments of tape with adhesive backing on a first face thereof are releasably mounted to the upper surface of the sheets. The tape segments include at least a first end portion having no exposed adhesive material adapted to be manually grasped for removal of the tape segments from the sheets. A chain or string is affixed to the package to allow it to be suspended from a rigid object.

7 Claims, 5 Drawing Figures

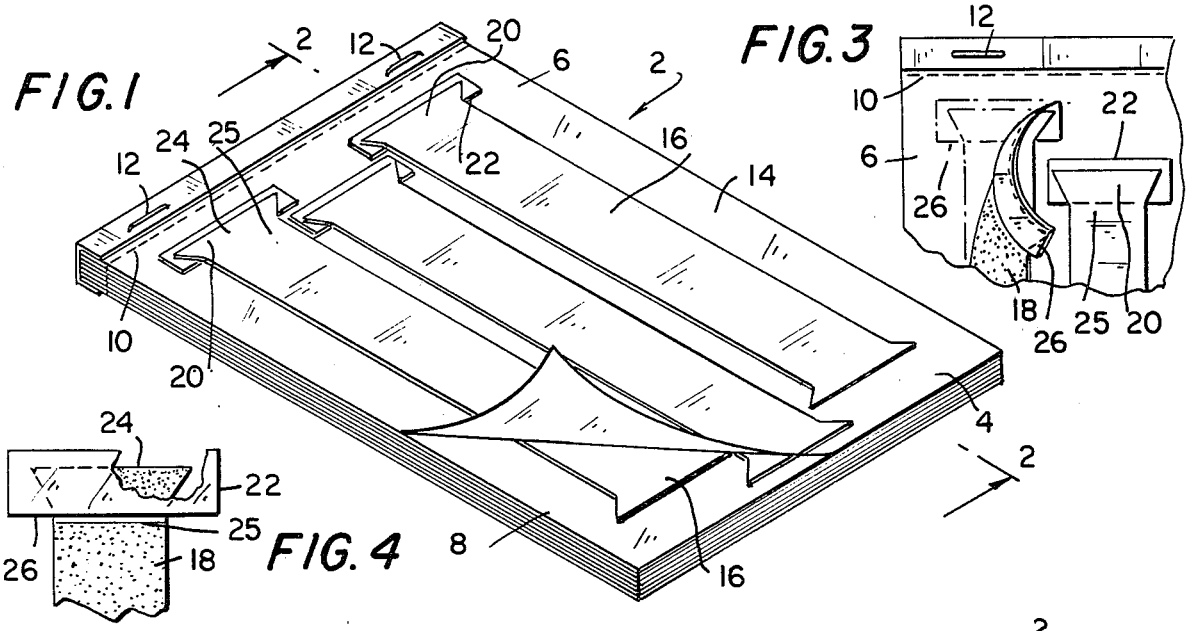
FIG.1
FIG.3
FIG.4
2
12
20
6
22
16
14
24
25
10
4
8
26
18
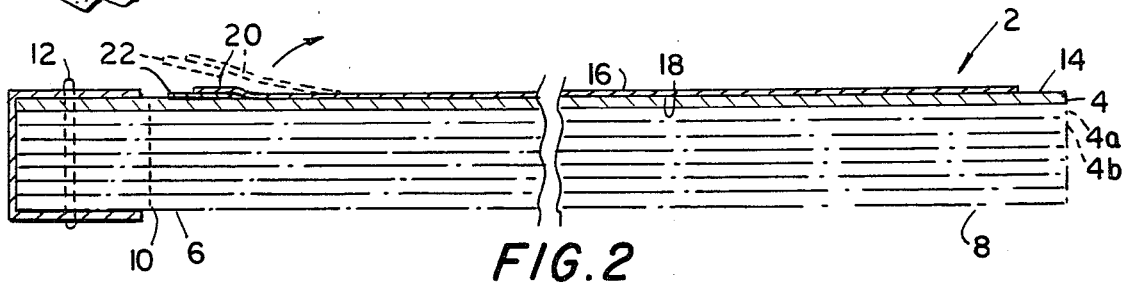
FIG.2
12
22
20
16
18
2
14
4
4a
4b
10
6
8
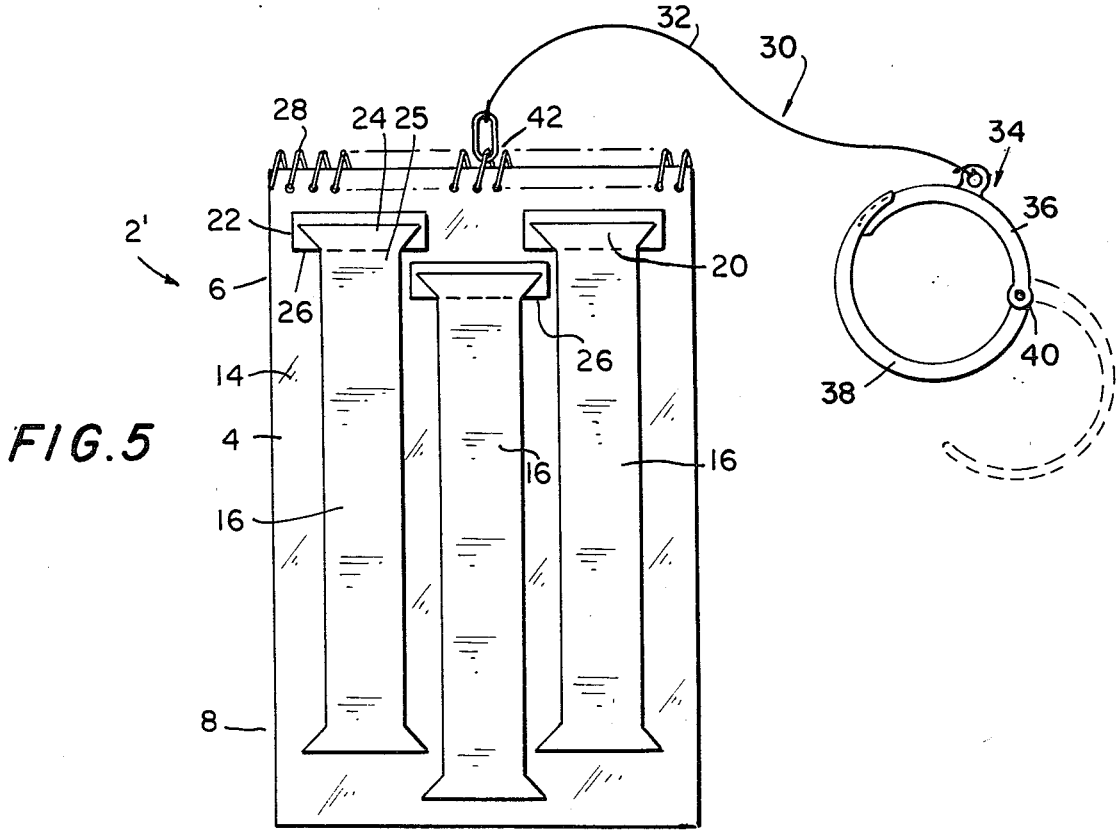
FIG.5
32
30
28
24
25
42
34
36
2'
22
6
26
20
14
4
16
38
40
8

PACKAGE FOR DISPENSING PRECUT TAPE SEGMENTS

The present invention relates generally to a package for dispensing precut segments of tape and, in particular, segments of tape useful in connection with disposable diapers.

Generally speaking, disposable diapers include a front portion adapted to be placed against the baby's belly and a rear portion to be placed against the baby's bottom. The rear portion generally includes two pieces of tape rigidly affixed to the edges of the rear portion of the diaper. These pieces of tape include masking sections which protect the adhesive material on the tape. When the diaper is put on the baby and the rear portion is to be fastened to the front portion, the masking material is peeled off, and the exposed adhesive material on the tape is applied to the front portion of the diaper and keeps the diaper in place.

A problem which has long plagued users of disposable diapers is that it is often possible to miscue or fumble the application of the tape. This may occur as a result of the baby squirming and kicking, or for a myriad of other reasons. The type of tape generally used on disposable diapers is of the type which, when applied once to the outer surface of the front portion of the diaper, adheres strongly to such outer portion immediately and cannot be removed and used again. Thus, if the tapes on a diaper are attached in an awkward position, or if the diaper is mounted too loosely, the tapes cannot be released and it might be necessary to totally discard the disposable diaper and use another one. Since such disposable diapers are normally quite expensive, most consumers hesitate to discard a clean diaper so readily.

A related problem that has developed revolves around the fact that a person diapering a baby, and the baby itself, will often come in contact with powders and lotions which, when they make contact with the adhesive material on the tapes, tend to render the adhesive material unusable. This may also cause the consumer to be faced with the prospect of discarding an essentially clean diaper.

It is accordingly an object of the present invention to provide consumers with a package of replacement tapes for use in connection with disposable diapers.

It is another object of the present invention to provide such tapes in a package allowing for one to readily and separately remove such tapes from the package.

It is a further object of the present invention to allow for removal of such tapes with one hand, while leaving the other hand free to hold the baby.

It is still a further object of the present invention to provide such replacement tapes in which the end portions of the adhesive material are protected from being contacted with materials which would cause the adhesive material to lose its effectiveness until such time as the application of the diaper is completed.

In an illustrative embodiment demonstrating certain aspects of the present invention, a package for storing and dispensing precut segments of tape with adhesive backing includes a plurality of pieces of sheet material having first and second ends and at least an upper surface with a smooth texture adapted to releasably retain tape with adhesive backing. The pieces of sheet material are releasably bound at the first ends of the pieces of sheet material and are constructed and arranged to allow removal of one of the sheets from the package. A plurality of elongated segments of tape with adhesive backing on a first face thereof are releasably mounted to the upper surface of the sheets. The tape segments include at least a first end portion having no exposed adhesive material adapted to be manually grasped for removal of the tape segments from the sheets.

The above brief description as well as further objects, features and advantages of the present invention will be more fully understood by reference to the following detailed description of a presently preferred, but nonethe-less illustrative embodiment in accordance with the present invention, when taken in conjunction with the accompanying drawing, wherein:

FIG. 1 is a perspective view of the representative form of the present invention;

FIG. 2 is a broken sectional elevational view taken substantially along the line 2—2 in FIG. 1;

FIG. 3 is a fragmentary, top plan view showing one such tape segment in the process of being removed from the sheet material;

FIG. 4 is a fragmentary, broken bottom plan view of an end portion of one such tape segment;

FIG. 5 is a top plan view of an alternative embodiment of the present invention in which the pieces of sheet material are attached to a spiral and further illustrating the means for suspending the package from a rigid object.

Referring now specifically to the drawing, and first to FIG. 1, there is shown an illustrative embodiment of the present invention and, in particular, a package 2 for storing and dispensing precut segments of tape. The package 2 includes a plurality of pieces of sheet material 4, 4*a*, 4*b*, etc. Each piece of sheet material 4 has a first end 6 and a second end 8. In the illustrative embodiment illustrated in FIG. 1, the pieces of sheet material 4 are rectangular sheets which extend longitudinally from the first end 6 to the second end 8. As seen in FIG. 1, the pieces of sheet material 4 have a precut perforation 10 at the first end 6 and are mounted by conventional staples 12 beyond the perforation 10. Thus, the pieces of sheet material 4 can be removed from the package 2 by tearing at the perforation 10.

The pieces of sheet material 4, 4*a*, etc. include at least an upper surface 14 with a smooth texture which is adapted to releasably retain tape with adhesive backing. It has been found that conventional wax paper will function quite well.

Each piece of sheet material 4 has mounted thereon a plurality of elongated, precut segments of tape 16 which have adhesive backing on a first face 18 thereof which is the underside of the segments of tape 16, as seen in FIGS. 1 and 2. The tape segments 16 are made with a type of adhesive backing which can be releasably mounted to and removed from the sheet material used in the pieces of sheet material 4. It has been found that the tape used on disposable diapers functions well, as does carpet tape.

As illustrated best in FIG. 1, a piece of sheet material 4 has three such tape segments 16 mounted thereon disposed in a generally parallel fashion in the longitudinal direction of the pieces of sheet material 4. Each tape segment 16 has a first end portion 20 which is preferably mounted proximate the first end 6 of the pieces of sheet material 4.

The first end portion 20 includes an area in which there is no exposed adhesive material, whereby the tape segment 16 may be manually grasped at said first end portion 20 for removal from the pieces of sheet material 4. As best seen in FIG. 2, the tape segments 16 are grasped at the first end portion 20 and are removed by pulling them in the direction from the first end 6 of the pieces of sheet material 4 to the second end 8 of the pieces of sheet material 4.

The first end portion 20 is essentially trapezoidal in shape and includes an outer region 24 having a greater width than the adjacent part 25 of the tape segment 16. As best illustrated in FIGS. 3 and 4, the first end portion 20 of the tape segments 16 include a tab 22 of sheet material releasably mounted to the adhesive material on the first end portion 20 of the tape segment 16. The tab 22 is made from material which is releasably removable from the adhesive material used in the tape segments 16. The tabs 22 are mounted to the first end portions 20 and cover substantially all of the adhesive material at the first end portions. As best illustrated in FIG. 4, the tab 22 is at least as wide as the outer region 24 and wider than the adjacent part 25 of the first end portion 20. Thus, at least a portion of the tabs 22 have an exposed edge 26 positioned longitudinally inward from the outer region 24. It will thus be appreciated that the tab 22 may be removed from the tape segment 16 by grasping the exposed edge 26 of the tab 22 and pulling it in a direction substantially toward the outer region 24.

As best illustrated in FIG. 1, the tape segments 16 have a trapezoidal shape both at the first end portion 20, as just discussed, but also at the opposite end of the tape segments 16. Generally speaking, the tape segments 16 should be substantially larger than the pieces of tape normally attached to disposable diapers, to allow for greater security and better binding of the diaper when the tape segments of the present invention are used. It has been found that tape segments which are approximately $4\frac{1}{2}$ inches long work effectively.

FIG. 5 illustrates an alternative embodiment of the present invention, in which the perforation 10 and staples 12 are replaced by a conventional spiral 28, which allows the pieces of sheet material 4' to be ripped from the package 2' in a conventional manner.

FIG. 5 also illustrates another feature of the present invention, the suspending means 30. A string or chain 32 is attached to the spiral 28 at a junction point 42 at approximately the middle thereof on one end and, at the other end, is attached to a conventional ring 34 having two pieces 36 and 38 mounted to each other through pivot 40. By attaching the ring 34 to a rigid object, the package 2' may be readily suspended to such object, such as a changing table or crib, to keep the package 2' handy and convenient. The suspending means 30 may also be attached through conventional means to a package 2, as illustrated in FIGS. 1 and 2, through means which will be readily understood by those skilled in the art.

To use the present invention and particularly the present invention including the suspending means feature as shown in FIG. 5, the ring 34 is attached to a convenient location on a rigid piece of furniture, such as a crib. The package 2' thus may dangle from the piece of furniture.

When the user wishes to help himself to a tape segment 16, he will grasp the first end portion 20 which, it will be understood, does not adhere to the pieces of sheet material 4 due to the presence of the tab 22. Thus, by using two fingers, the user will place one finger on the non-adhesive face of the tape segment 16 and the other finger on the tab 22. The user then pulls the tape segment 16 off from the pieces of sheet material 4 in a direction from the first end 6 toward the second end 8. Since the package 2' is suspended at the first end 6 to the string or chain 32, pulling in the direction just described will allow the package to be restrained by the suspending means 30 and will avoid the effect of "pushing on a string."

The tape segment 16 is then placed on the diaper in the most advantageous position and, when this is done, the tab 22 is still attached at the first end portion 20. The user then can then grasp the exposed edge 26 of the tab 22 and pull it in a direction toward the end of the tape segment 16. This will allow the adhesive material at the outermost portion of the tape segment to remain clean and free from powder and the like until the diapering job is substantially complete.

The present illustrative embodiments show three tape segments 16 on each page, positioned to make efficient use of the space in view of their wide ends. It will be appreciated that essentially any shape of pieces of sheet material 4 may be used and any appropriate number of tape segments 16 may be applied thereto. Eventually, the user will use all of the tape segments 16 on a given piece of sheet material 4. At that time, the entire piece of sheet material 4 may be removed from the package 2 by simply tearing it off, leaving exposed yet another piece of sheet material 4 with tape segments 16 mounted thereon as previously described.

Although the present illustrative embodiment of the present invention features the tape segment 16 mounted parallel to each other, it may be advantageous to orientate the tape segments 16 somewhat differently whereby, when they are removed from the package 2, the package 2 will not swivel about the junction point 42 at which the string or chain 32 is mounted to the spiral 28. Thus, it will be appreciated that, as illustrated in FIG. 5, if the ring 34 is mounted directly "above" the package 2', when the middle tape segment 16 is removed, there should be little or no canting, but, when either of the outer tape segments 16 are removed, there may be some canting due to a twisting moment about the junction point 42. Thus, if the outer tape segments 16 are positioned so as to be essentially colinear with the junction point 42, the canting effect may be avoided.

As will be readily apparent to those skilled in the art, the invention described may be used in other specific forms without departing from its spirit or essential characteristics. By way of example only, and without limiting the foregoing, while the present description has been directed to pieces of tape useful in connection with disposable diapers, the present invention may also be utilized in other contexts in which individual pieces of tape are needed. For example, the present invention could be utilized appropriately in wrapping packages where the wrapper requires one hand to hold the paper in place and needs to be able to grab a single piece of tape with the other hand. The present embodiment is, therefore, considered as illustrative and not restrictive, the scope of the invention being indicated by the claims rather than the foregoing description, and all changes coming within the meaning and range of equivalents of the claims are therefore intended to be embraced therein.

What is claimed is:

1. A package for storing and dispensing precut segments of tape with adhesive backing comprising: a plurality of pieces of sheet material having first and second ends and at least an upper surface with a smooth texture adapted to releasably retain tape with adhesive backing, said pieces of sheet material being releasably bound at said first ends of said pieces of sheet material and constructed and arranged to allow removal of one of said sheets from said package, and a plurality of elongated segments of tape with adhesive backing on a first face thereof releasably mounted to said upper surface of said sheets, said tape segments including at least a first end portion having no exposed adhesive material adapted to be manually grasped for removal of said tape segments from said pieces of sheet material.

2. A package according to claim 1, wherein said tape segments on each of said sheets are disposed with said first ends of said tape segments proximate said first ends of said sheets, and wherein said tape segments are adapted to be removed from said pieces of sheet material by grasping said first end portion and pulling in a direction from said first end toward said second end of said pieces of sheet material.

3. A package according to claim 1, wherein said first end portion of each of said tape segments includes adhesive material on said first face of said tape segments at said first end portion, and further comprising a tab of sheet material releasably mounted to said adhesive material on said first end portion covering substantially all of said adhesive material at said first end portion and extending beyond at least one outer edge of said first end portion of said tape segment.

4. A package according to claim 3, wherein said first end portions of said tape segments include an outer region having a lateral width in excess of the width of the adjacent part of said first end portion and wherein said tabs extend at least as wide as said lateral width of said outer region and wider than said adjacent part of said first end portion whereby at least a portion of said tabs have an exposed edge positioned longitudinally inward from said outer region and whereby said tab may be removed from said tape segment by grasping said exposed edge.

5. A package according to claim 1, further comprising means for suspending said package from a rigid object with said suspending means affixed to said package proximate said first ends of said sheets.

6. A package according to claim 5, wherein said tape segments on each of said sheets are disposed with said first ends of said tape segments proximate said first ends of said sheets.

7. A package according to claim 5 wherein at least one of said tape segments is substantially colinear with the point at which said suspending means is affixed to said package.

* * * * *